US006722914B2

(12) United States Patent
Blaha

(10) Patent No.: US 6,722,914 B2
(45) **Date of Patent: *Apr. 20, 2004**

(54) WIRE CONNECTOR WITH EXTENSION

(75) Inventor: William E. Blaha, St. Charles, IL (US)

(73) Assignee: Ideal Industries, Inc., Sycamore, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/492,369

(22) Filed: Jan. 27, 2000

(65) Prior Publication Data

US 2002/0160649 A1 Oct. 31, 2002

(51) Int. Cl.[7] ..... H01R 11/20

(52) U.S. Cl. ..... 439/404; 439/405; 439/409; 439/417; 439/107; 439/397

(58) Field of Search ..... 439/404, 405, 439/409, 397, 107, 417, 100, 403, 402, 438, 439, 441, 507, 412, 413, 395, 418

(56) References Cited

U.S. PATENT DOCUMENTS 3,588,788 A * 6/1971 Francis ..... 339/98
3,899,236 A * 8/1975 Santos ..... 439/402
4,722,579 A * 2/1988 Cumming et al. ..... 439/391
4,824,395 A 4/1989 Blaha
4,891,018 A * 1/1990 Afflerbaugh et al. ..... 439/402
5,080,606 A * 1/1992 Burkard ..... 439/403
5,453,021 A * 9/1995 Smith ..... 439/395
5,531,618 A 7/1996 Market
5,547,391 A * 8/1996 Benes et al. ..... 439/402
5,597,321 A * 1/1997 Jacques ..... 439/417
RE35,476 E * 3/1997 Levy ..... 439/411
5,622,515 A * 4/1997 Hotea et al. ..... 439/398
5,708,234 A 1/1998 Frontierro
5,735,706 A * 4/1998 Ito ..... 439/402
5,860,829 A * 1/1999 Hower et al. ..... 439/417
5,890,924 A * 4/1999 Endo et al. ..... 439/417
5,975,939 A 11/1999 Market
6,015,312 A * 1/2000 Escane ..... 439/417
6,135,805 A * 10/2000 Sowinski ..... 439/402

* cited by examiner

*Primary Examiner*—Truc Nguyen
(74) *Attorney, Agent, or Firm*—Cook, Alex, McFarron, Manzo, Cummings & Mehler, Ltd.

(57) ABSTRACT

A wire connector has a housing with a conductive clip therein. First and second retaining fingers are formed in the clip. Each finger engages a wire inserted into the housing to hold the wire in the housing. The fingers can be arranged for either a push-in or insulation displacement type connection. A conductive extension is electrically connected to the clip and extends out of the housing for connection to the terminus of an external electrical apparatus.

8 Claims, 3 Drawing Sheets

WIRE CONNECTOR WITH EXTENSION

BACKGROUND OF THE INVENTION

This invention relates to wire connectors and is particularly concerned with a connector that can electrically connect two or more wires to a common terminus of a separate, external device. Connectors of this general description are shown in U.S. Pat. Nos. 5,975,939 and 5,531,618. These two patents disclose a twist-on connector having a housing with a metallic spring therein for engaging the exposed conductors of two or more wires inserted into the housing. The spring is locked to the housing. The housing and spring combination is twisted onto the ends of the conductors of the wires being joined. The twisting action causes the spring to bite into the conductors and retain the housing on the conductors. A terminal blade in electrical contact with the spring protrudes through the housing to make the blade available for connection to an external common terminus. Thus, the wires joined in the twist-on housing are connectable to the common terminus.

There may be instances where it is not desirable to use the twist-on connector of the prior art. Installations that require the connector housing to be first attached to the common terminus of the external device and then connected to the wires cannot use a twist-on connector. This is because the twisting action needed to lock the prior art connector to the wires cannot be done if the connector's terminal blade is already fixed to the external device. Also, the prior art connector works only with stripped wires, which may not always be convenient. Furthermore, twist-on connectors have inherent limits in the number of wires they can accommodate. The present invention provides connector constructions that overcome these situations.

SUMMARY OF THE INVENTION

The present invention is a wire connector having a conductive clip with fingers inside an insulative housing. A conductive extension is in permanent engagement with the clip and extends out of the housing where it is connectable to a terminus of an external device. The extension may be in the form of a terminal blade or a pigtail. The clip fingers engage the conductors of wires inserted into the housing to provide both mechanical and electrical connection. The fingers may be arranged for push-in connection to the stripped ends of incoming wires or for insulation displacement connection to unstripped wires.

DETAILED DESCRIPTION OF THE INVENTION

Figure 1:
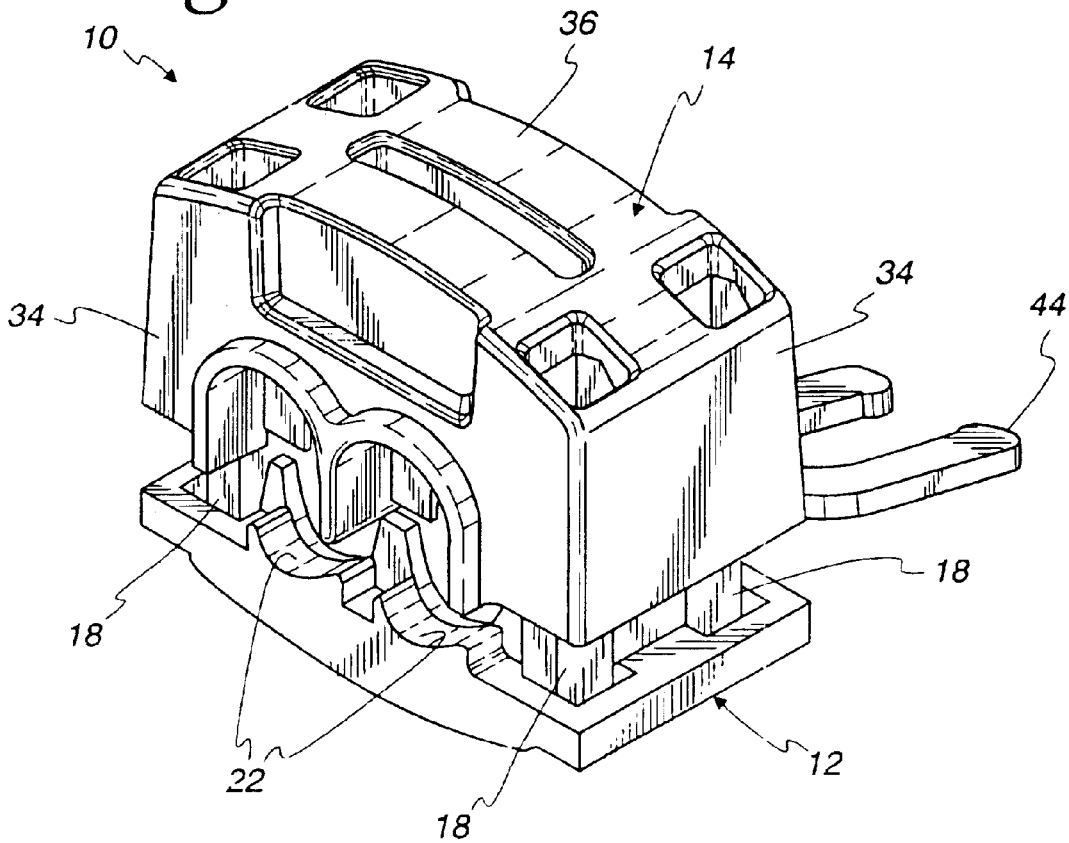
FIG. 1 is a perspective view of a connector according to the present invention having an insulation displacement type clip and housing.
Figure 2:
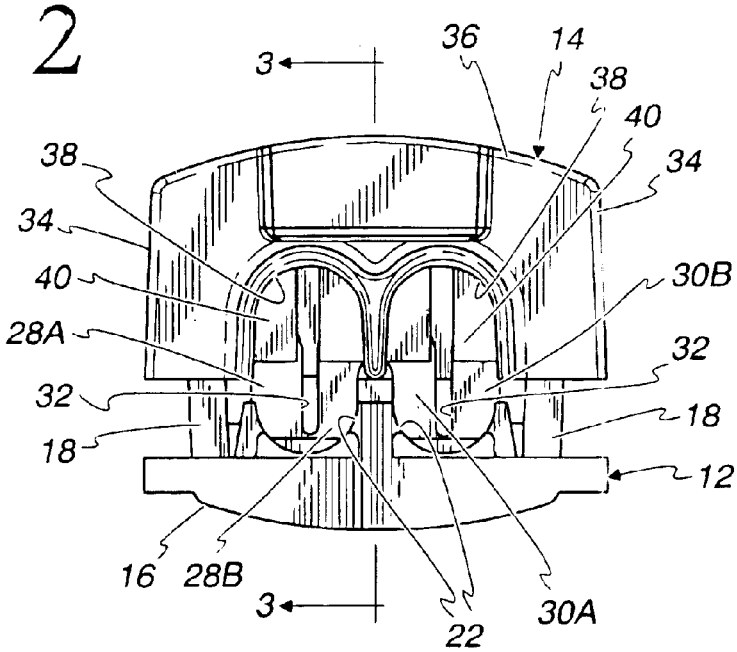
FIG. 2 is a front elevation view of the connector of FIG. 1.
Figure 3:
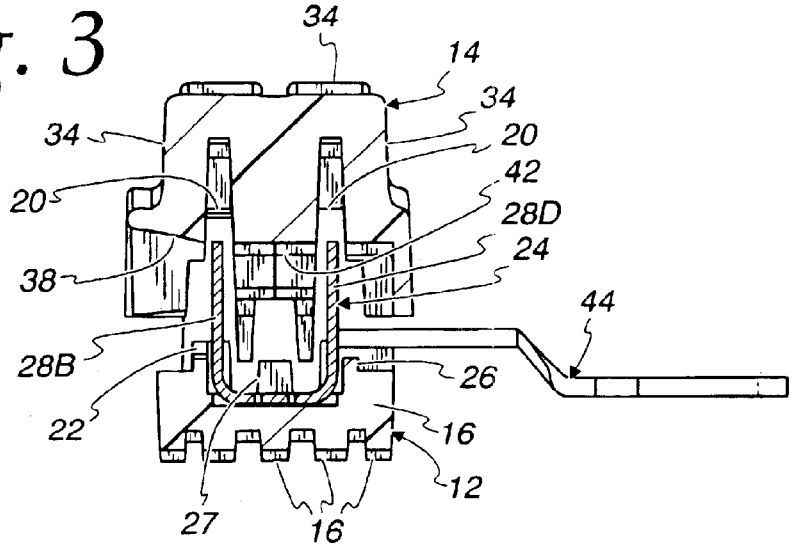
FIG. 3 is a section taken along line 3—3 of FIG. 2.

FIGS. 1–3 illustrate one form of the wire connector of the present invention. This version is an insulation displacement connector 10 having a two-part housing. The housing includes a base portion 12 and a cap portion 14. The cap is preferably attached to the base by a flexible hinge. The base has a generally planar, rectangular platform with spaced reinforcing ribs 16. Four upstanding prongs 18 are located near the corners of the platform. The prongs have hooks 20 (FIG. 3) formed at their upper ends for engaging the cap 14 to hold it on the connector. The base 12 also has arcuate cradles 22 along a front edge and a rear wall 26 along a back edge. The cradles partially define openings through which incoming wires may extend into the interior of the housing.

The base 12 mounts an electrically conductive clip shown generally at 24. The clip is retained between the cradles 22 and the rear wall 26. The lateral edges of the clip may be heat staked or sonic welded to the base 12 by a post 27. The clip in this embodiment is a copper element that is generally U-shaped in end elevation (i.e., as seen in FIG. 3). The clip 24 has a bail in contact with the base 12, an upstanding front leg adjacent the cradles 22 and an upstanding rear leg adjacent the rear wall 26. In this embodiment the front leg is divided into separate tines 28A, 28B and 30A, 30B. The tines are separated by slots 32. The rear leg is similarly divided into four tines, only one of which is visible (at 28D in FIG. 3) because the rear leg tines are directly behind or aligned with the front leg tines, as seen in FIG. 2. As with the front leg tines, the rear leg tines define slots which are aligned with the slots 32 of the front leg tines. Collectively the tines 28 define a set of retaining fingers which engage an individual incoming conductor to hold the conductor fixed in the housing. Tines 30 act similarly on a second conductor. Further details of a conductive clip similar to clip 24 are shown and described in U.S. patent application Ser. No. 09/272,530, filed on Mar. 22, 1999 and assigned to the present assignee, the disclosure of which is incorporated herein by reference.

Looking now at the cap 14, it has a generally five-sided enclosure defined by side walls 34 and an end wall 36. The walls define a cavity which will receive the prongs 18 and the clip 24 when the cap is closed on the base 12. The front wall 34 of the cap has two arcuate apertures 38 with slotted thin webs 40 partially spanning the apertures. The apertures 38 are aligned with the cradles 22. Together the apertures 38 and cradles 22 define openings that permit incoming wires to extend into the cavity of the housing. The underside of the cap end wall has a ledge 42 across the central portion thereof.

Extending out the back of the housing is a conductive extension or terminal 44. In this embodiment the extension is in the form of a fork. The extension is electrically engaged with the clip 24 by soldering, braising, welding or crimping. Alternately the extension could be formed integrally with the rest of the clip 24. It will be understood that the extension or terminal configuration could be other than a fork and include a ring or disconnect (male or female) type terminal.

The use, operation and function of the connector of FIGS. 1–3 are as follows. To connect two wires, a user places the wires over the top of the front and rear clip legs, aligned with the slots 32. Then the cap 14 is placed over the prongs 18 and pressed downwardly toward the base 12. In so doing, the ledge 42 drives the wires down into the slots between the retainer fingers 28 and 30. The finger tines cut through the insulation layer and engage the conductors underneath the insulation. The webs 40 will flex around the exterior of the insulation to help prevent entry of dirt or debris. When the cap 14 is fully driven home, the hooks 20 on the prongs 18 will engage the cap and prevent its removal. The user may then connect the housing to an external apparatus (not shown) by placing the fork 44 around a suitable terminus, such as a screw or lug. The two conductors are then joined to that external device's terminus.

Figure 4:
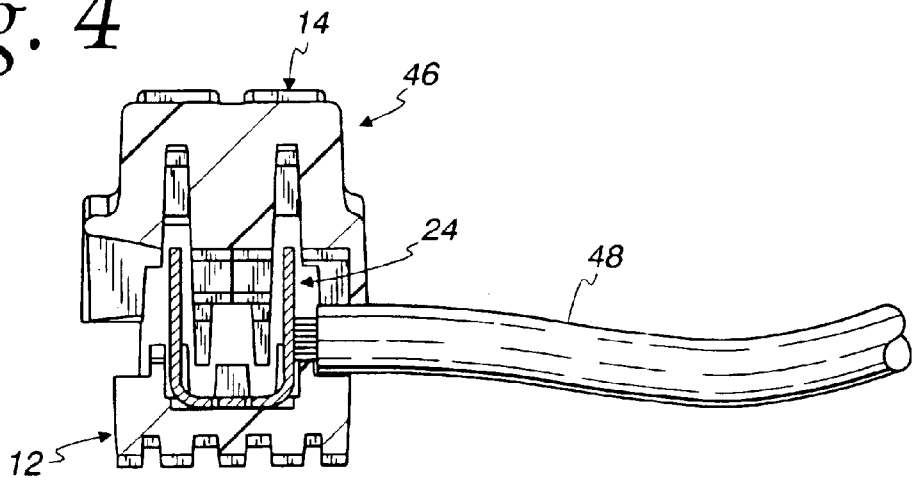
FIG. 4 is a section similar to FIG. 3 showing an alternate embodiment having a pigtail extension.

FIG. 4 shows an alternate version 46 of the connector. This connector is also an insulation displacement type connector having a housing that is identical to the housing shown in FIGS. 1–3 and, thus, its description will not be repeated. An electrically conductive clip is disposed within the housing. This clip is also the same as in FIGS. 1–3. FIG. 4 differs from the previous embodiment in that its electrical extension is a pigtail 48. The pigtail is simply a conductor surrounded by an insulating jacket. The conductor is electrically connected to the clip 24 by any of the methods described above. The use and operation of the connector of FIG. 4 is the same as previously described with the exception that the pigtail 48 will be connected to an external device's terminus by some means appropriate for a wire instead of a blade.

Figure 5:
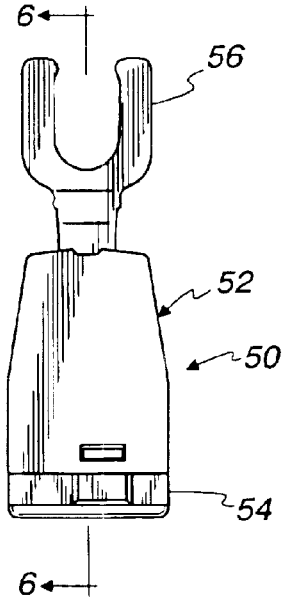
FIG. 5 is a plan view of a further alternate embodiment having a push-in type clip and housing.
Figure 6:
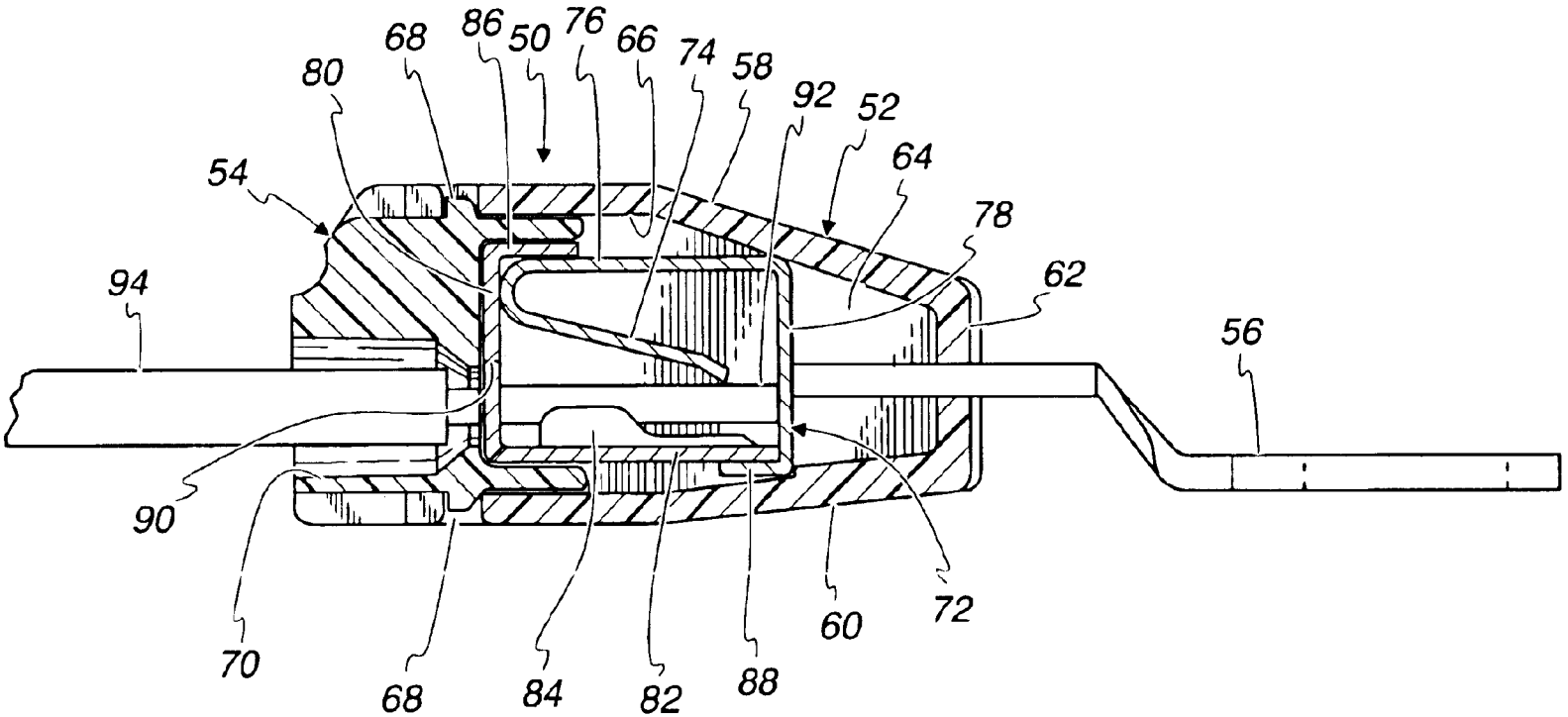
FIG. 6 is a section, on an enlarged scale, taken along line 6—6 of FIG. 5.

A further alternate embodiment of the present invention is shown in FIGS. 5 and 6. This connector 50 has a housing 52 having an open end which is normally filled by a plug 54. Extending from the other end of the housing is a conductive extension 56. In this embodiment, the extension is a fork although any of the previously described extensions could be used. A pigtail wire could also be used.

Details of the connector 50 are shown in FIG. 6. The housing 52 has a top wall 58, a bottom wall 60 an end wall 62 and two side walls, one of which is seen at 64. Together these walls define a cavity as indicated at 66. The left end of the housing as seen in FIG. 6 is open but normally filled by the plug 54. The plug has top and bottom tabs 68 that engage slots in the top and bottom walls 58, 60 to hold the plug in the housing. The plug also has a pair of conductor openings, one of which is shown at 70. Inside the cavity is an electrically conductive clip 72. In this embodiment, the clip is formed of two metal pieces. A first piece has first and second retaining fingers, one of which is seen at 74. The retaining finger is flexibly connected to an upper portion 76 which in turn adjoins a vertical portion 78. The second piece of the conductive clip includes a front section 80 and a base section 82 with a seat 84 formed therein. The seat 84 helps stabilize a conductor inserted into the housing. The front section 80 has a small turned over corner 86 which engages the upper portion 76 of the first clip piece. Similarly, vertical portion 78 has a foot 88 that engages the base section 82. The front section 80 has a pair of openings 90 for receiving conductors.

A conductive extension 56 is in electrical engagement with the clip 72. This may be accomplished with any of the methods described above. Alternatively, the extension could be a pigtail whose conductor may be compressed between the base section 82, foot 88 and the bottom housing wall 60. It will be understood that there are at least two fingers 74 associated with each clip 72. An alternate arrangement of a push-in clip is shown in U.S. Pat. No. 4,824,395, the disclosure of which is incorporated herein by reference.

The use and operation of the connector 50 are as follows. Incoming wires have a conductor 92 and an insulating jacket 94. The ends of the insulation must be stripped to, expose the conductor 92 at the end of the wire. Then each wire is inserted into the housing through opening 70 in the plug 54 and the opening 90 in the conductive clip 72. As the conductor enters through opening 90, it engages the finger 74, flexing it upwardly (as seen in FIG. 6). The finger 74 presses against the conductor making electrical connection. The resiliency of the finger also causes it to press against the conductor 92 and resist any release or pulling out of the wire. Two wires are inserted in this fashion. The connector 50 can then be attached to an external electrical apparatus (not shown) by appropriate and conventional use of the extension 56.

It will be noted that the connector of FIGS. 1–4 requires no preparation of the wires being connected, other than cutting them to the appropriate length. The connector of FIGS. 5 and 6 requires the additional step of stripping the ends of the conductors. In each instance, however, no twisting of the conductors is needed. A user simply closes the cap in the insulation displacement version or inserts the wires in the push-in version. The connectors are then ready for attachment to an external device. It will be further noted that with any of the embodiments of the invention the order in which attachments are made could be reversed from that described above. That is, the housing could be first attached to the terminus of an external device and then the wires could be inserted into the housing.

While a preferred form of the invention has been shown and described, it will be realized that alterations and modifications may be made thereto without departing from the scope of the following claims. While the connectors are generally described above as accommodating two wires, other numbers of wires could be involved. For example, three or more wires could be connected by enlarging the housing and providing a clip with three or more fingers for, receiving those wires.

What is claimed is:

1. A wire connector for electrically joining two or more incoming wires having conductors, comprising:

a housing having walls defining a cavity therein with openings in the walls, said openings permitting the incoming wires to extend into the cavity;

an electrically conductive clip disposed in the cavity and held fixed and non-movable in the housing by the walls, the clip having at least first and second retaining fingers each of which engages an individual conductor to hold the conductor fixed in the housing such that the conductive clip electrically joins each conductor of the two or more incoming wires; and a conductive extension in shorting electrical engagement with the clip and extending through a housing wall to an exterior of the housing, at least a portion of the extension on the exterior of the housing being electrically conductive.

2. The wire connector of claim 1 wherein the conductive clip has a plurality of tines forming an insulation displacement type connector.

3. The wire connector of claim 2 having a two-part housing including a base an a cap.

4. The wire connector of claim 1 wherein the conductive slip has a plurality of fingers forming a push-in type connector.

5. The wire connector of claim 1 wherein the extension is a blade-type terminal.

6. The wire connector of claim 1 wherein the extension is a pigtail.

7. A method of electrically connecting two or more wires having conductors to a common terminus, comprising the steps of providing a push-in wire connector having a conductive clip inside an insulative housing, the housing having walls and the conductive clip held fixed and non-movable in the housing by the walls, providing a conductive extension electrically shorted to the clip and extending to an exterior of the housing, pushing stripped ends of the conductors of the first and second wires into the housing and into engagement with the clip, and electrically connecting the extension to said terminus.

8. A method of electrically connecting two or more wires having conductors to a common terminus, comprising the steps of providing an insulation displacement connector having a conductive clip inside an insulative housing, the housing having walls and the conductive clip held fixed and non-movable in the housing by the walls, providing a conductive extension electrically shorted to the clip and extending to en exterior of the housing, placing first and second wires adjacent the clip, closing the housing to force the wires' conductors into engagement with the clip, and electrically connecting the extension to said terminus.

* * * * *